US006540106B2

(12) United States Patent
Gerstner

(10) Patent No.: US 6,540,106 B2
(45) Date of Patent: Apr. 1, 2003

(54) FINGER ATTACHABLE SPRAY DEVICE

(76) Inventor: Norman G. Gerstner, P.O. Box 232, Reedsport, OR (US) 97467

( * ) Notice: Subject to any disclaimer, the term of this patent is extended or adjusted under 35 U.S.C. 154(b) by 0 days.

(21) Appl. No.: 09/861,145

(22) Filed: May 21, 2001

(65) Prior Publication Data

US 2002/0170927 A1 Nov. 21, 2002

(51) Int. Cl.[7] ..... B65D 35/08

(52) U.S. Cl. ..... 222/78; 222/175; 222/107; 42/1.09

(58) Field of Search ..... 222/95, 92, 105–107, 222/78, 175; 42/1.09; 63/1.15, 1.14

(56) References Cited

U.S. PATENT DOCUMENTS 3,473,524 A * 10/1969 Drewe ..... 600/578
4,061,249 A * 12/1977 Smith ..... 222/78
4,135,645 A * 1/1979 Kimmell ..... 222/83
4,748,759 A * 6/1988 Whiteing ..... 222/78
5,358,144 A * 10/1994 Mock ..... 222/78
5,669,529 A * 9/1997 Levit ..... 222/78

* cited by examiner

*Primary Examiner*—Gene Mancene
*Assistant Examiner*—Stephanie Willatt
(74) *Attorney, Agent, or Firm*—James D. Givnan, Jr.

(57) ABSTRACT

A tubular reservoir for wear on a finger contains a deterrent to ward off an assailant. A housing, defining the reservoir, collapses upon flexing of the finger to propel the deterrent for nozzle discharge. A cap is carried by a retainer which is rapidly dislodged by a finger adjacent the finger worn device.

9 Claims, 2 Drawing Sheets

FINGER ATTACHABLE SPRAY DEVICE

BACKGROUND OF THE INVENTION

The present invention pertains to a self-defense device and particularly to that type of device emitting a liquid deterrent such as mace.

Small containers of a pressurized liquid for use as a self-defense purpose are common. Such containers may contain a quantity of mace or pepper spray and have a finger actuated valve contents. While use of such containers may deter an attack on the person, a problem exists in the actuation of same. Such containers are normally carried in a pocket or a purse are largely useless in the event of an unanticipated attack. Further, a mace or pepper spray container must be, to some extent, aimed at an attacker to be effective. Accordingly, the usefulness of such containers is diminished by the difficulty in rapidly accessing the container and the aiming of same.

SUMMARY OF THE PRESENT INVENTION

The present invention is embodied within a spray discharging device which is worn on a finger of the user and readily actuated by flexing of the finger. The device includes a chamber in which a quantity of liquid is carried with flexure of the device by the finger causing discharge of the liquid in the direction of the pointed finger. A lip of the device facilitates flexure of the device and release of a deterrent fluid.

Important objectives of the present device include the provision of a receptacle charged with a deterrent liquid which is carried on a finger of the user in an unobtrusive manner and capable of rapid discharge of the fluid simply by flexing of the finger; the provision of an inconspicuous self-defense device that enables the immediate discharge of a deterrent upon the device being partially collapsed by flexing of a supporting finger; the provision of a self-defensive device which spray emit a deterrent toward the face of an aggressor simply by pointing of the finger toward the aggressor and flexing the finger; the provision of a self-defense device which includes a quantity of liquid and having a cap releasable by a finger or thumb adjacent the finger on which the device is worn.

DETAILED DESCRIPTION OF THE PREFERRED EMBODIMENTS

Figure 1:
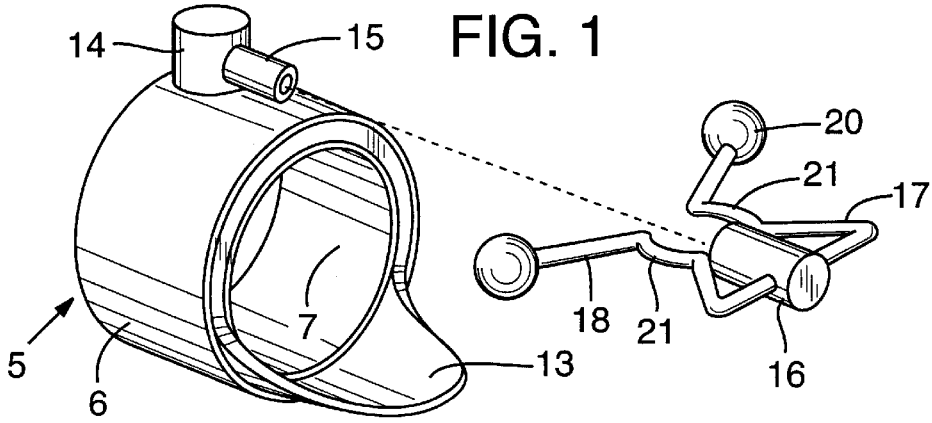
FIG. 1 is an exploded perspective view of the present device.

With continuing attention to the drawings wherein applied reference numerals indicate parts similarly hereinafter identified, the reference numeral 1 indicates generally a finger of the user, preferably an index finger, having phalanges at 2, 3 and 4 of a hand at H.

The present device is of tubular configuration with a housing having an outer flexible member 6 and a radially spaced, inner flexible member 7. In one suitable embodiment of the device, the outer and inner flexible members may be of rubber of a semi-rigid nature so as to permit flexing but when unbiased are concentric to define an annular chamber at 8.

Chamber 8 is closed at its ends by a first ring at 10 which may be termed a fixed ring while a second ring 11, termed a movable ring, is supported in an axially spaced apart relationship from ring 10 by flexible members 6 and 7, attached to the rings by a suitable adhesive. Said rings define the chamber 8 along with and inner and outer flexible sleeves 6 and 7, for the reception of a quantity of a sprayable deterrent at 12. A projection 13 on ring 11 projects toward the distal end of finger 1, which is inserted through the device, to locate projection 13 below second phalange 3 as shown in FIG. 1. Extension 13 serves as a trigger to activate the device as further elaborated.

Ring 10 is provided with a nozzle 15 including a nozzle support 14 on the ring. A passageway 19 in the ring delivers fluid to the support and nozzle 15. Nozzle 15 is directed toward the distal end of a wearer's finger 1 when the device is operatively positioned. A cap 16 frictionally engages nozzle 15. The cap is elongate and is held in place on nozzle 15 by a retainer 17 having arms 18 which terminate in fittings 20 which serve to receive finger tip pressure from either thumb of the wearer's two hands to permit separation of retainer 17 and of cap 16 integral therewith. Upon cap separation, nozzle 15 conducts deterrent liquid from chamber 8 and discharges same in a spray pattern in a direction approximately parallel to the axis of finger phalanx 4.

Actuation of the device entails phalanx 3 being displaced downwardly toward projection 13 which, in turn, causes displacement of ring 11 toward ring 10 to pressurize fluid 12 in chamber 8. Prior to such actuation the cap 16 is separated by the user's thumb acting on fitting 20 to remove cap 16. It will be apparent that cap removal and pressurization of the device by flexing of the wearer's finger 1 will be virtually instantaneous as it requires only displacement of retainer 17 and cap 16 by the user's thumb and pointing of the finger 1 (typically the index finger) toward the aggressor and downward flexing of phalanx 3. The retainer 17 is shaped at 21 to engage nozzle support 14 in a biased manner to normally retain cap 16 in place. Finger tip pressure on either fitting 20, depending on which hand the device is located, will urge retainer 17 in a forward or distal direction to the extent the nozzle is uncapped.

Figure 2:
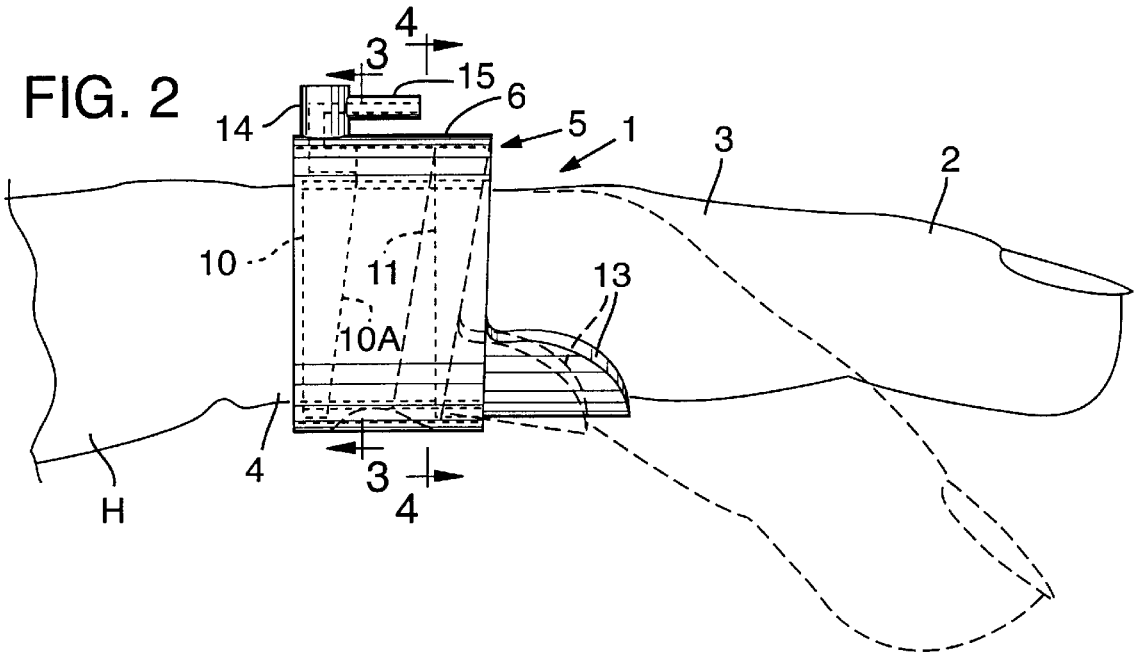
FIG. 2 is a view showing the present self-defense device in place on a finger of a user.
Figure 3:
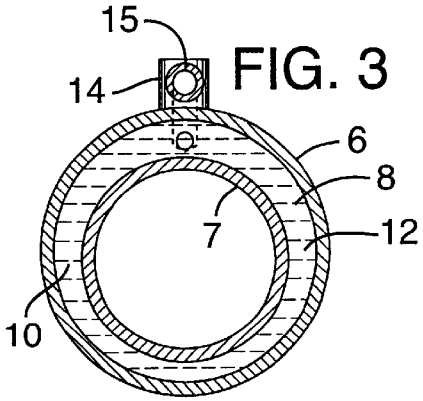
FIG. 3 and FIG. 4 are vertical sectional views taken along lines 3 and 4 of FIG. 1 and showing respectively a fixed portion and a displaceable portion of the device.
Figure 4:
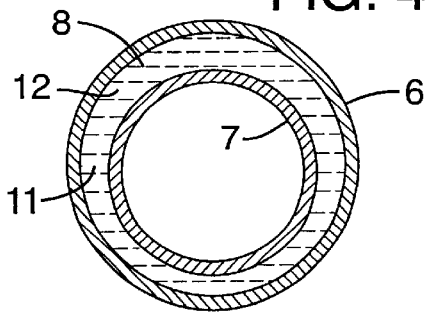
Figure 5:
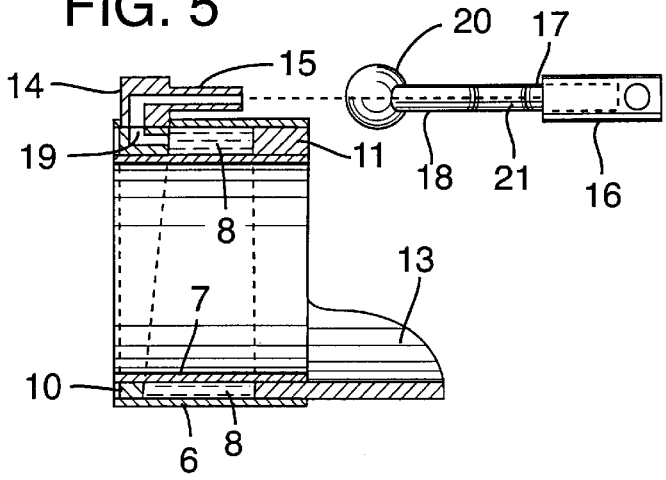
FIG. 5 is a vertical sectional view of the device.
Figure 6:
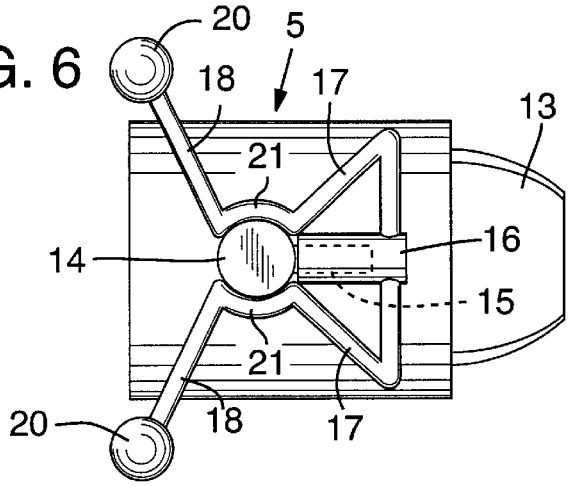
FIG. 6 is a plan view of the device removed from a finger.
Figure 7:
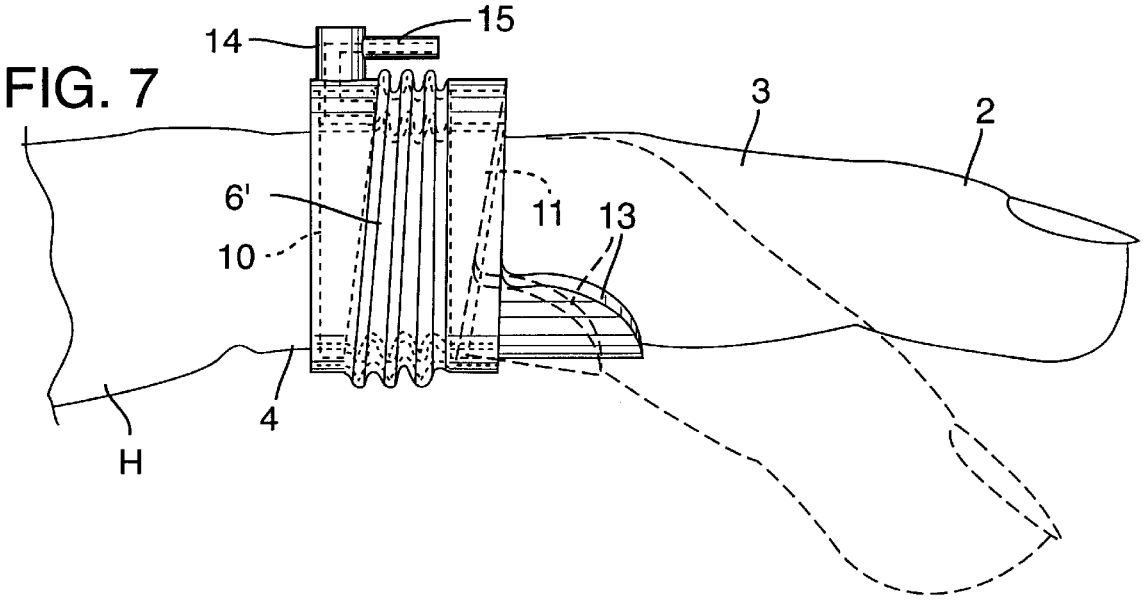
FIG. 7 is a view similar to FIG. 2 and showing a modified form of the device.

With attention to FIG. 2, upon downward flexing of phalanx 3 ring 11 will be displaced toward ring 10, as shown in broken lines, to reduce the volume of chamber 8 and pressurizing a deterent fluid 12 therein. Ring members 6 and 7 are of flexible material permitting same to collapse during ring actuation. Cap 16 will have been detached from nozzle 15 prior to actuation of the present device.

The range of travel of movable or second ring 11, during collapsing of the device, is enhanced by a bevel at 10A on ring 10.

While I have shown but a few forms of the device, it will be apparent to those skilled in the art that the invention may be embodied still otherwise without departing from the spirit and scope of the claimed invention.

Having thus described the invention, what is desired to be secured by a Letters Patent is:

1. A device for discharging liquid deterrent to repel an assailant, said device comprising, a housing of tubular configuration for placement on a finger of the user and having concentric flexible sleeves defining a chamber for the storage of a liquid deterrent, annular members supporting said sleeves, one of said members including a projection for disposition adjacent a phalanx of the user's finger and displaceable upon flexing of the finger to displace said one of said annular members to collapse said sleeves and expel fluid from the chamber, and a nozzle carried by said housing in communication with the chamber to discharge liquid upon flexing of the sleeves.

2. The tubular container claimed in claim 1 wherein said housing comprises radially spaced apart tubular members.

3. The tubular container claimed in claim 2 wherein said tubular members are lengths of tubing.

4. The tubular container claimed in claim 3 wherein said tubing is corrugated.

5. A protective device for wearing on a finger and including, a tubular body including flexible means for defining a chamber of annular shape for reception of a fluid, rings each adjacent an end of the tubular body, a nozzle in communication with said chamber, and one of said rings including a projection extending in an axial direction beyond said tubular body for disposition subjacent a phalanx of the user's finger, flexing of the finger serving to collapse the tubular body to the extent fluid is discharged from the chamber through the nozzle assembly.

6. A tubular container having open ends for placement on a person's finger including, an elongate collapsible housing defining a chamber for storage of a fluid, a nozzle in communication with said chamber, said housing collapsed upon flexing of the finger to expel a fluid from said chamber through said nozzle, wherein said housing includes end members, wherein one of said members includes a projection for placement adjacent the user's finger to serve as a trigger.

7. The tubular container claimed in claim 3 wherein said end members are of annular shape, said nozzle carried by one of said end members.

8. The tubular container claimed in claim 3 additionally including a cap in place in said nozzle.

9. The tubular container claimed in claim 8 wherein said cap includes a fitting engageable with a finger facilitating rapid removal of said cap.

* * * * *